United States Patent [19]

Nishikawa et al.

[11] 4,076,403

[45] Feb. 28, 1978

[54] ELECTROGRAPHIC PROCESS

[75] Inventors: Masaji Nishikawa, Hachioji; Eiichi Sato, Tama, both of Japan

[73] Assignee: Olympus Optical Co., Ltd., Tokyo, Japan

[21] Appl. No.: 747,527

[22] Filed: Dec. 6, 1976

[30] Foreign Application Priority Data

Dec. 11, 1975 Japan ..... 50-146830

[51] Int. Cl.[2] ..... G03G 15/00

[52] U.S. Cl. ..... 355/35 C; 96/1 R; 355/8

[58] Field of Search ..... 355/35 C, 3 DR, 4, 8, 355/3 R; 96/1 R

[56] References Cited

U.S. PATENT DOCUMENTS

| | | | |
|---|---|---|---|
| 3,811,765 | 5/1974 | Blake | 355/35 C |
| 3,898,085 | 8/1975 | Suzuki et al. | 355/35 C |
| 4,006,983 | 2/1977 | Pressman et al. | 355/4 |

*Primary Examiner*—R. L. Moses

*Attorney, Agent, or Firm*—Haseltine, Lake & Waters

[57] ABSTRACT

An electrographic process of producing, on a dielectric coated image receiving body, an electrostatic charge image corresponding to an image to be recorded is disclosed. The process comprises making a radius of curvature of a screen-shaped photosensitive body different from that of the dielectric coated image receiving body, arranging these two bodies in opposed and spaced apart relation and driving these two bodies at surface speeds which are different from each other.

3 Claims, 7 Drawing Figures

ELECTROGRAPHIC PROCESS

This invention relates to an electrographic process which makes use of a secreen-shaped photosensitive body composed of at least one electric conductive layer and at least one photoconductive layer and which comprises uniformly charging said photoconductive layer, illuminating said screen-shaped photosensitive body with a light image corresponding to a picture image of a manuscript to be recorded so as to form an electrostatic latent image on said photoconductive layer, directing a flow of corona ions through said screen-shaped photosensitive body toward a dielectric coated image receiving body and controlling said flow of corona ions by said electrostatic latent image to form, on said dielectric coated image receiving body, an electrostatic charge image corresponding to an image corresponding to an image to be recorded.

Various types of electrographic apparatuses practicing such electrographic process have been well known. If the dielectric coated image receiving body is an electrostatic record sheet, the electrostatic charge image formed on the record sheet is developed by a toner in a conventional manner to obtain a final reproduced picture image. If the dielectric coated image receiving body is a transfer plate, the electrostatic latent image formed on the transfer plate is developed by a toner in a conventional manner to obtain a toner image which is then transferred to an ordinary record sheet and finally fixed. In this case, the electrostatic latent image on the transfer plate is extremely stationary, so that a number of recopies are obtained from the same electrostatic latent image with the aid of means of preventing the picture image from being confused.

In the electrographic apparatus, it is sometimes desirous that the screen-shaped photosensitive body or the dielectric coated image receiving body is of shapes other than flat, that is, arcuate or drum-shaped and the screen-shaped photosensitive body is different in shape from the dielectric coated image receiving body. Particularly, in the electrographic process in which the toner image is transferred to the ordinary record sheet, it is quite preferable to use a transfer drum. In such a case, if the surface speed of the screen-shaped photosensitive body is made equal to that of the dielectric coated image receiving body, dots of the picture image become deformed and elongated in the manuscript scanning direction, thereby degrading the resolution of the recorded picture image.

In the conventional electrographic apparatus which makes use of a photosensitive drum and in which a record sheet or a transfer body is arranged close to the photosensitive drum, it is possible to make the surface speed of the photosensitive drum equal to that of the record sheet or the transfer body.

On the contrary, in the case of using a screen-shaped photosensitive body composed of at least one electric conductive layer and photoconductive layer in accordance with the invention, it is impossible, in principle, to arrange the screen-shaped photosensitive body close to the record sheet or the transfer body, so that the former is spaced apart from the latter. Experimental tests have shown that in such a case a flow of ions must be made extremely narrow for the purpose of obtaining a good picture image. If the width of the flow of ions is wide, the dots of the picture image are deformed and become elongated in the manuscript scanning direction thereby significantly degrading the resolution of the recorded picture image. On the other hand, if the width of the flow of ions is narrow, the recording speed is required to be late thus hindering a high speed recording operation. Many attempts have heretofore been made to solve such contradictory problem, but such attempts were made without success.

An object of the invention, therefore, is to provide an electrographic process which can very efficiency and easily solve the above mentioned problem by driving a screen-shaped photosensitive body at a surface speed which is different from that of a dielectric coated image receiving body when an electrostatic image is projected from the screen-shaped photosensitive body to the dielectric coated image receiving body.

A feature of the invention is the provision of an electrographic process comprising using a screen-shaped photosensitive body composed of at least one electric conductive layer and photoconductive layer, uniformly charging said photoconductive layer, illuminating said screen-shaped photosensitive body with a light image corresponding to a picture image of a manuscript to be recorded so as to form an electrostatic latent image on said photoconductive layer, directing a flow of corona ions through said screen-shaped photosensitive body toward a dielectric coated image receiving body and controlling said flow of corona ions by said electrostative latent image to form on said dielectric coated image receiving body an electrostatic charge image corresponding to an image to be recorded, said process comprising a further step of making a radius of curvature of said screen-shaped photosensitive body different from that of said dielectric coated image receiving body, arranging these two bodies in opposed and spaced apart relation and driving said two bodies at surface speeds which are different from each other.

On the one hand, if the screen-shaped photosensitive body and the dielectric coated image receiving body are driven at surface speeds which are different from each other, the magnification of the picture image in the manuscript scanning direction becomes different from that in a direction perpendicular to the manuscript scanning direction thus resulting in a disadvantage that a copy having a correct aspect ratio could not be obtained. This is particularly vital defect in the case of reproducing drawings.

Another feature of the invention is the provision of an electrographic process which can obviate such disadvantage and which can obtain a picture image whose aspect ratio is not changeable and correct. In the electrographic process according to the invention, a manuscript scanning speed is made different from a surface speed of a screen-shaped photosensitive body and a cylindrical concave or convex lens for changing a projection magnification in the manuscript scanning direction only is arranged in an optical system for projecting a manuscript image on the screen-shaped photosensitive body.

The invention will now be described in greater detail with reference to the accompanying drawings, wherein.

Figure 1A:
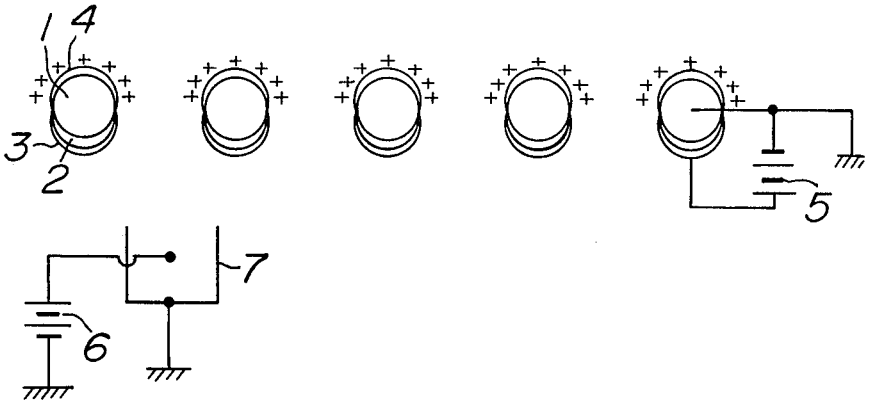
FIGS. 1A, 1B and 1C are schematic views showing successive steps for illustrating a record principle of an electrographic process according to the invention.
Figure 1B:
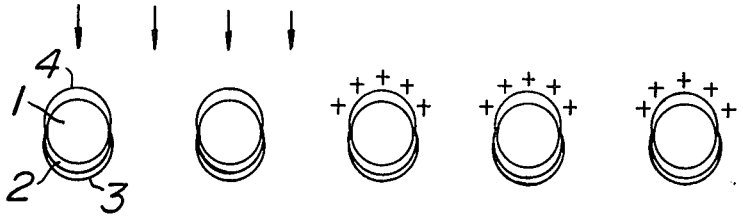
Figure 1C:
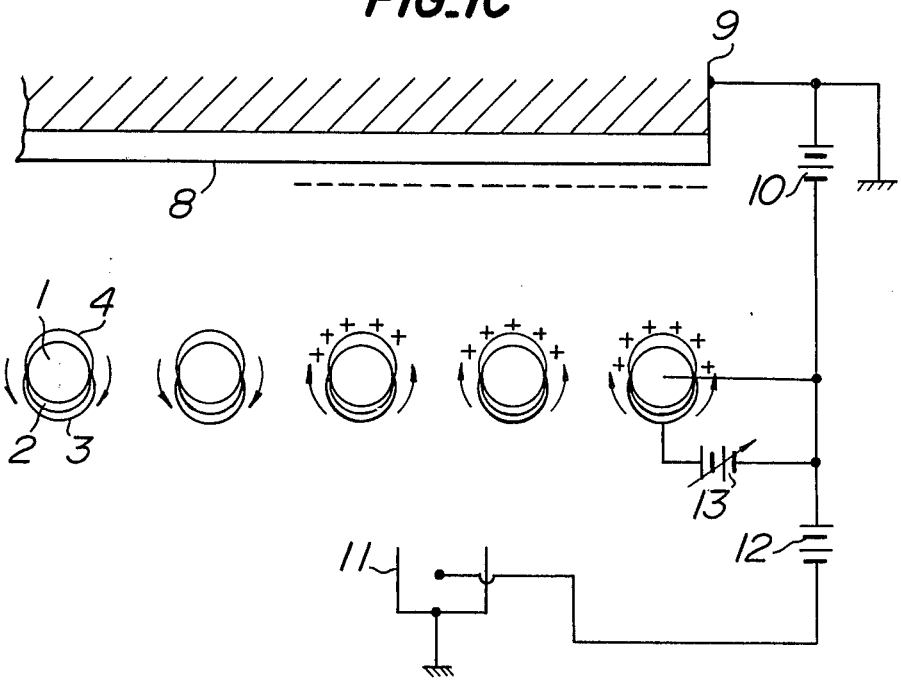

FIGS. 1A, 1B and 1C are schematic views showing successive steps of an electrographic process which makes use of a screen-shaped photosensitive body formed of four layers composed of an insulating layer, two electric conductive layers disposed diametrically opposite sides of the insulating layer and a photoconductive layer disposed on one of the electric conductive layers. In the present example, the screen-shaped photosensitive body is composed of a mesh-shaped electric conductive core 1, an insulating layer 2 and an electric layer 3 superimposed one upon the other one one side of the mesh-shaped electric onductive core 1 and a photosensitive layer 4 disposed on the opposite side thereof. Across the electric conductive core 1 and the electric conductive layer 3 is connected a bias electric source 5.

As shown in FIG. 1A, in the first place, the photosensitive layer 4 is uniformly charged with a desired potential by means of a corona discharge device 7 connected to a corona electric source 6. In the present example, the charging step is accomplished by the corona discharge device 7 arranged at the side of the electric conductive layer 3. Alternatively, the corona discharge device 7 may be arranged at the side of the photosensitive layer 4 to accomplish the same charging step. In the first charging step, the bias electric source 5 functions to uniformly charge the photosensitive layer 4 with the desired potential. But, the charging step may be accomplished without using the bias electric source 5.

In FIG. 1B is shown a second step in which the photosensitive layer 4 is illuminated by a light image corresponding to a manuscript to be reproduced. That part of the photosensitive layer 4 which is illuminated by the light image reduces its resistance value and the electric charge thereon becomes decreased or eliminated. That part of the photosensitive layer 4 which is not illuminated by the light image maintains its high resistance value and the electric charge thereon is remained as it is. In this way, an electrostatic latent image corresponding to the light image is formed on the photosensitive layer 4.

In FIG. 1C is shown a third step in which an electrostatic record sheet 8 and a field electrode 9 are arranged in opposition to the photosensitive layer 4 of the screen-shaped photosensitive body and spaced apart therefrom. Across the screen-shaped photosensitive body and the field electrode 9 is applied a high electric voltage from an accelerating electric source 10 and a flow of ions is directed from a corona discharge device 11 arranged at the side of the electric conductive layer 3 of the screen-shaped photosensitive body through the screen-shaped photosensitive body toward the electrostatic record sheet 8. In this case, a polarity of a corona electric source 12 is made opposite to that of the corona electric source 6 used in the first step shown in FIG. 1A. As a result, in the screen meshes is produced a force which acts in a direction shown by an arrow with respect to the flow of ions. That is, in that part of the screen at which the electric charge remains on the photosensitive layer 4 this force acts in a direction to aid pass of the flow of ions, while in that part of the screen at which the electric charge is absent the force acts in a direction to block the pass of the flow of ions.

After the above mentioned successive steps, an electrostatic picture image corresponding to the picture image on the manuscript is produced on the record sheet 8. The electrostative picture image produced on the record sheet 8 is developed by a toner in the conventional manner and then fixed to obtain a final picture image.

Figure 2:
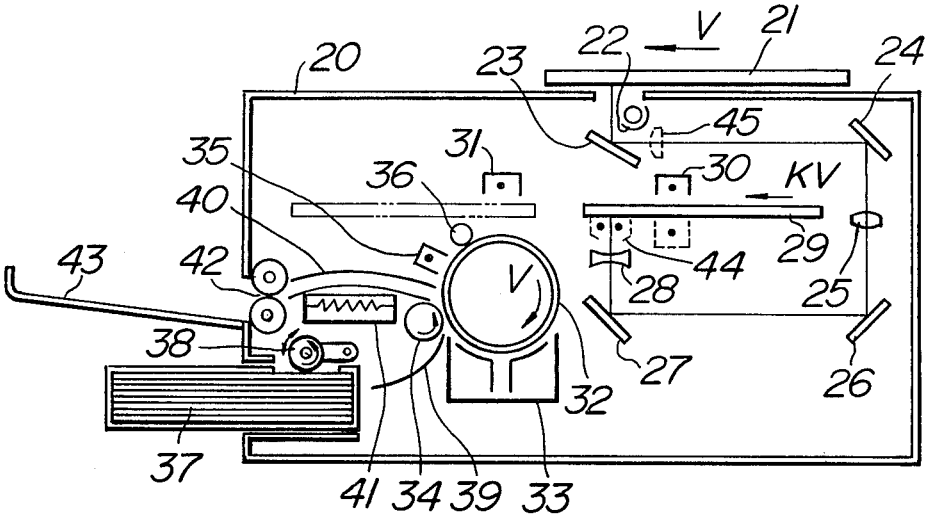
FIG. 2 is a schematic view showing one embodiment of an apparatus for practicing the electrographic process according to the invention.

In FIG. 2 is shown one embodiment of an electographic apparatus practicing the above described principle. In the present embodiment, use is made of a screen-shaped photosensitive plate and a transfer drum. On a casing 20 is movaly mounted a carriage 21 for supporting a manuscript to be reproduced. The manuscript is illuminated by a lamp 22 and a reflected light is projected through a mirror 23, a mirror 24, a projecting lens 25, a mirror 26, a mirror 27 and a cylindrical concave lens 28 on a screen-shaped photosensitive plate 29. The screen-shaped photosensitive plate 29 is made movable in a horizontal direction. Above a passage way of the screen-shaped photosensitive plate 29 are fixedly arranged a first corona discharge device 30 and a second corona discharge device 31. Below the passage way of the screen-shaped photosensitive plate 29 is rotatably arranged a transfer drum 32. Along the periphery of the transfer drum 32 are arranged a developing device 33, a transfer roller 34, an alternating current corona discharge device 35 for removing a residual electric charge from the transfer drum 32 and a cleaning roller 36. In addition, provision is made of a record sheet cassette 37, a feed roller 38 for taking up the record sheet one by one from the cassette 37, a first sheet guide 39 for guiding the record sheet delivered from the feed roller 38 into a space formed between the transfer drum 32 and the transfer roller 34, a second sheet guide 40 for guiding the record sheet delivered from the transfer drum 32 and the transfer roller 34, a heater 41 arranged below and along the second sheet guide 40, sheet feed rollers 42 for feeding the record sheet delivered from the second sheet guide 40 to the outside of the apparatus, and a tray 43 for collecting and superimposing the record sheet delivered from the sheet feed rollers 42 one upon the other.

The present embodiment of the electrographic apparatus practicing the electrographic process according to the invention will operate as follows. A manuscript to be reproduced is set on the manuscript carriage 21. In this condition, the screen-shaped photosensitive plate 29 is located at a full line position shown in FIG. 2 and uniformly charged by the first corona discharge device 30. Then, the manuscript carriage 21 is moved at a constant speed in a direction shown by an arrow and at the same time the screen-shaped photosensitive plate 29 is moved at a constant speed in a direction shown by an arrow. During the movement of the manuscript carriage 21 and the screen-shaped photosensitive plate 29, a light image corresponding to a picture image of the manuscript is projected onto the screen-shaped photosensitive plate 29 to form, on the screen-shaped photosensitive plate 27, an electrostatic latent image corresponding to the picture image of the manuscript. The screen-shaped photosensitive plate 29 with the electrostatic latent image formed thereon reaches to a space formed between the second corona discharge device 31 and the transfer drum 32. The second corona discharge device 31 causes a flow of corona ions to direct through the meshes of the screen-shaped photosensitive plate 27 toward the transfer drum 32. In this case, the flow of corona ions is modulated by the electrostatic charge on the screen-shaped photosensitive plate 29, whereby an electrostatic charge image corresponding to an image to be reproduced is transferred to the transfer drum 32 which is also rotated at a constant speed. This electrostatic charge image is developed by the developing device 33 and a toner image thus developed is transferred to a record sheet guided between the transfer roller 34 and the transfer drum 32. Finally, the toner picture image transferred to the record sheet is heated by the heater 41 and fixed and then delivered to the outside of the apparatus.

In the present invention, the moving speed of the screen-shaped photosensitive plate 29 is made different from the surface speed of the tranfer drum 32. That is, let the surface speed of the transfer drum 32 be V, then the moving speed of the screen-shaped photosensitive plate 29 is made KV. K is a coefficient which is larger than 1 and which can experimentally and theoretically be determined by a distance between the screen-shaped photosensitive plate 29 and the transfer drum 32, a diameter of the transfer drum 32, a diffusion angle of a flow of corona ions directed from the second corona discharge device 31 etc.. The manuscript carriage 21 is moved at the same speed as the surface speed V of the transfer drum 32. Such speed relation between the transfer drum 32 and the manuscript carriage 21 on the one hand and the screen-shaped photosensitive plate 29 on the other hand renders it possible to make a deformation of dots on the recorded picture image minimum even if a width of a flow of ions directed from the second corona discharge device 31 is wide, thereby obtaining a picture image having an excellent resolution. In addition, the use of a flow of ions having a wide width provides the important advantage that a recording speed is high.

As described above, if the moving speed KV of the screen-shaped photosensitive plate 29 is different from the moving speed V of the manuscript carriage 21, a dismension of the electrostatic latent image formed on the screen-shaped photosensitive plate 29 becomes K times longer in the scanning direction of the manuscript. As a result, a dimension of the final record picture becomes K times longer in the scanning direction of the manuscript, so that an aspect ratio of the final record picture becomes different from that of the manuscript. In order to correct such change of the aspect ratio, in the embodiment shown in FIG. 2, a cylindrical concave lens 28 is arranged in an optical system for projecting the manuscript image on the screen-shaped photosensitive plate 29 so as to reduce a projection magnification by 1/K smaller in the scanning direction of the manuscript. The use of such cylindrical concave lens 28 which can reduce the projection magnification by 1/K smaller in the scanning direction of the manuscript ensures a correction of the change of the aspect ratio of the picture image caused by driving the screen-shaped photosensitive plate 29 and the transfer drum 32 with a ratio of KV:K.

Figure 3:
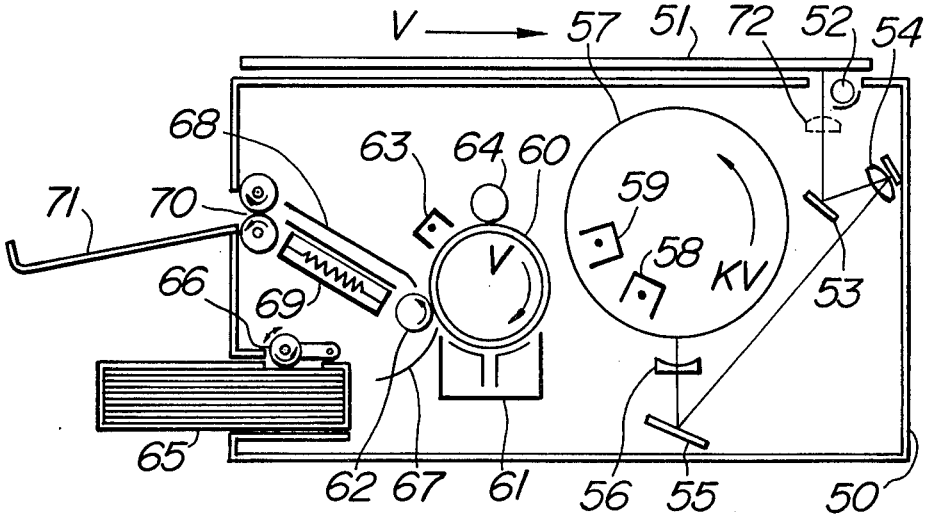
FIG. 3 is a similar schematic view showing another embodiment of an apparatus for practicing the electrographic process according to the invention.

In FIG. 3 is shown another embodiment of the electrographic apparatus practicing the electrographic process according to the invention. In the present embodiment, use is made of a screen-shaped photosensitive drum and an electrostatic latent image formed thereon is tranferred to a transfer drum whose diameter is different from that of the screen-shaped photosensitive drum. In the present embodiment, on a casing 50 is movably mounted a manuscript carriage 51 for supporting a manuscript to be reproduced. Inside the casing 50 is arranged a lamp 52 for illuminating the manuscript. A light reflected from the manuscript is projected through a mirror 53, an inmirror lens 54, a mirror 55 and a cylindrical concave lens 56 on the screen-shaped photosensitive drum 57. A first corona discharge device 58 and a second corona discharge device 59 are arranged along the inner periphery of the screen-shaped photosensitive drum 57. Provision is made of a transfer drum 60 having a diameter which is smaller than that of the screen-shaped photosenstivie drum 57.

The transfer drum 60 is opposed to and spaced apart from the screen-shaped photosensitive drum 57. Along the periphery of the transfer drum 60 are arranged a developing device 61, a transfer roller 62, and alternating current corona discharge device 63 for removing a residual electric change from the transfer drum 60 and a cleaning roller 64. In addition, provision is made of a sheet cassette 65 for containing record sheets superimposed one upon the other, a feed roller 66 for taking up the record sheet one by one from the cassette 65, a first sheet guide 67 for guiding the record sheet delivered from the cassette 65 to a space formed between the transfer drum 60 and the transfer roller 62, a second sheet guide 68 for guiding the record sheet delivered from the space formed between the transfer drum 60 and the transfer roller 62, a heater 69 arranged below and extending along the second sheet guide 68, a pair of feed rollers 70 for delivering the record sheet recorded with final picture image, and a tray 71 for collecting the record sheets delivered out of the casing 50 and superimposing these record sheets one upon the other.

The operation of producing, on the dielectric coated record sheet, the electrostatic charge image corresponding to the image to be recorded is basically the same as that described with reference to the above described previous embodiment shown in FIG. 2, so that its detailed explanation is omitted. In the present embodiment, both the manuscript carriage 51 and the transfer drum 60 are rotated at a speed V, while the screen-shaped photosensitive drum 57 is rotated at a speed KV ($K>1$). Even if a width of a flow of corona ions directed from the second corona discharge device 59 is wide, there is no risk of dots of the picture image being deformed in the scanning direction of the second sheet, so that a good picture image can be obtained. In addition, a recording speed can be made high.

As described above, if the rotating speed KV of the screen-shaped photosensitive drum 57 is different from the moving speed V of the manuscript carriage 51, a dimension of the electrostatic latent image formed on the screen-shaped photosensitive drum 57 becomes K times longer in the scanning direction of the manuscript. As a result, a dimension of the final record picture becomes K times longer in the scanning direction of the manuscript, so that an aspect ratio of the final record picture becomes different from that of the manuscript. In order to correct such change of the aspect ratio, in the embodiment shown in FIG. 3, a cylindrical concave lens 56 is arranged in an optical system for projecting a manuscript image on the screen-shaped photosensitive drum 57 so as to reduce a projection magnification by 1/K smaller in the scanning direction of the manuscript. The use of such cylindrical concave lens 56 which can reduce the projection magnification by 1/K smaller in the scanning direction of the manuscript ensures a correction of the change of the aspect ratio of the picture image caused by driving the screen-shaped photosensitive drum 57 and the transfer drum 60 with a ratio of KV:V.

Figure 4A:
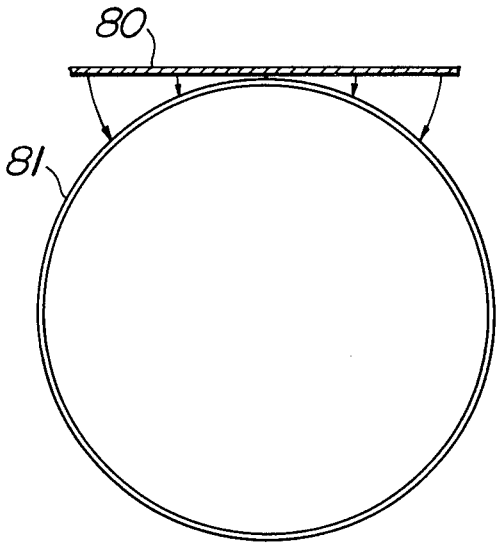
FIGS. 4A and 4C are schematic views showing electric fields established between a screen-shaped photosensitive body and a dielectric coated image receiving body.

In FIG. 4A is shown electric field produced between a screen-shaped photosensitive plate 80 which corresponds to the screen-shaped photosensitive plate 29 shown in FIG. 2 and a dielectric coated image receiving drum 81 which corresponds to the transfer drum 32 shown in FIG. 2.

Figure 4B:
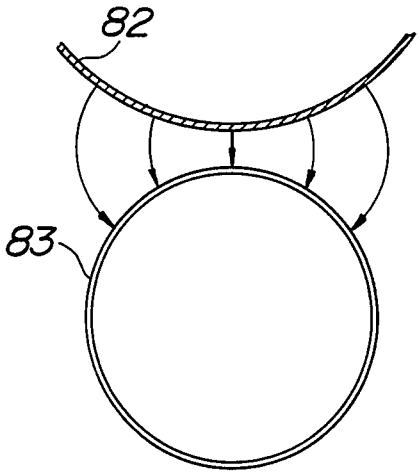

In FIG. 4B is shown electric field produced between a screen-shaped photosensitive drum 82 which corresponds to the screen-shaped photosensitive drum 57 shown in FIG. 3 and a dielectric coated image receiving drum 83 which corresponds to the transfer drum 60 shown in FIG. 3, these drums 82 and 83 being different in diameter as in the case of FIG. 3.

As can be seen from FIGS. 4A and 4B, a pitch between two adjacent lines of electric force on the screen-shaped photosensitive body 80, 82 becomes shorter on the dielectric coated image receiving body 81, 83. A rate of shortening the pitch on dielectric coated image receiving body 81, 83 is different from place to place along the periphery thereof. But, in practice, it is possible to determine an optimum value of K which is an average value given by an effective projecting width of the flow of corona ions directed from the second corona discharge device 31, 59.

The invention is not limited to the above described embodiments and many alternations and modifications may be made. For example, the construction of the screen-shaped photosensitive body is not limited to that shown in FIG. 1A and use may be made of various types of screen-shaped photosensitive bodies. After uniform charge of the screen-shaped photosensitive body, it may be charged with opposite polarity or with alternating current while simultaneously illuminating it with light image with the aid of a corona discharge device 44 shown by dotted lines in FIG. 2. Alternatively, a cylindrical convex lens 45 may be used instead of the cylindrical concave lens 28 arranged in the optical system for projecting the manuscript image on the screen-shaped photosensitive body. In this case, however, the cylindrical convex lens 45 is required to be arranged between the manuscript and the projection lens 25 as shown by dotted lines in FIG. 2. In the apparatus shown in FIG. 3, a cylindrical convex lens 72 may be arranged between the manuscript and the projection lens 54 as shown by dotted lines in FIG. 3. If the third step shown in FIG. 1C is accomplished independently of the previous second step, the scanning speed V for each step is not always necessary to be set to the same value.

What is claimed is:

1. An electrographic process comprising using a screen-shaped photosensitive body composed of at least one electric conductive layer and photoconductive layer, uniformly charging said photoconductive layer, illuminating said screen-shaped photosensitive body with a light image corresponding to a picture image of a manuscript to be recorded so as to form an electrostatic latent image on said photoconductive layer, directing a flow of corona ions through said screen-shaped photosensitive body toward a dielectric coated image receiving body and controlling said flow of corona ions by said electrostatic latent image to form, on said dielectric coated image receiving body, an electrostatic charge image corresponding to an image to be recorded, said process comprising a further step of making a radius of curvature of said screen-shaped photosensitive body different from that of said dielectric coated image receiving body, arranging these two bodies in opposed and spaced apart relation and driving said two bodies at surface speeds which are different from each other.

2. An electrographic process as claimed in claim 1, wherein a manuscript scanning speed is made different from a surface speed of said screen-shaped photosensitive body and a cylindrical concave lens for changing a projection magnification in the manuscript scanning direction only is arranged in an optical system for projecting a manuscript picture image on said screen-shaped photosensitive body.

3. An electrographic process as claimed in claim 1, wherein a manuscript scanning speed is made different from a moving speed of said screen-shaped photosensitive body and a cylindrical convex lens for changing a projection magnification in the manuscript scanning direction only is arranged in an optical system for projecting a manuscript picture image on said screen-shaped photosensitive body.

* * * * *

Notice of Adverse Decision in Interference

In Interference No. 100,113, involving Patent No. 4,076,403, M. Nishikawa and E. Sato, ELECTROGRAPHIC PROCESS, final judgment adverse to the patentees was rendered July 18, 1980, as to claims 1 and 3.

[*Official Gazette November 18, 1980.*]